US005894802A

United States Patent [19]

Jackson

[11] Patent Number: 5,894,802

[45] Date of Patent: Apr. 20, 1999

[54] METHOD AND APPARATUS FOR ESTABLISHING AN ISOLATED POSITION REFERENCE IN A PRINTING OPERATION

[75] Inventor: Dale Hiett Jackson, Newmarket, N.H.

[73] Assignee: Heidelberger Druckmaschinen AG, Heidelberg, Germany

[21] Appl. No.: 08/975,710

[22] Filed: Nov. 21, 1997

[51] Int. Cl.[6] ..... B41F 31/00

[52] U.S. Cl. ..... 101/485; 101/248; 318/652

[58] Field of Search ..... 101/485, 248, 101/180, 181, 183, 136, 137, 138, 139, 140, 177, 179, 229, 230; 318/640, 652, 99; 356/430; 73/600; 382/112

[56] References Cited

U.S. PATENT DOCUMENTS

| | | | |
|---|---|---|---|
| 3,845,366 | 10/1974 | Metzler et al. | 318/99 |
| 4,495,582 | 1/1985 | Dessert et al. | 101/248 |
| 4,495,583 | 1/1985 | Punater | 101/248 |
| 4,839,814 | 6/1989 | Steidel | 101/248 |
| 4,885,785 | 12/1989 | Reynolds et al. | 382/112 |
| 4,901,577 | 2/1990 | Roberts | 73/600 |
| 5,049,798 | 9/1991 | Jackson | 318/640 |
| 5,243,408 | 9/1993 | Whitman, III | 356/430 |
| 5,481,971 | 1/1996 | Grützmacher | 101/183 |
| 5,615,609 | 4/1997 | Hill et al. | 101/183 |
| 5,619,635 | 4/1997 | Millman et al. | 395/768 |

*Primary Examiner*—Eugene Eickholt
*Attorney, Agent, or Firm*—Burns, Doane, Swecker & Mathis, LLP

[57] ABSTRACT

An apparatus and method for providing disturbance-free speed and position references to drive units in a web-fed printing press to minimize or eliminate detrimental effects on printing speed and quality caused by transient mechanical disturbances occurring at one or more of the drive units during printing.

26 Claims, 5 Drawing Sheets

METHOD AND APPARATUS FOR ESTABLISHING AN ISOLATED POSITION REFERENCE IN A PRINTING OPERATION

BACKGROUND OF THE INVENTION

1. Field of the Invention

The present invention relates generally to position regulation in printing systems. More particularly, the present invention relates to a control system for a printing press that regulates relative positions of drive units within the press.

2. State of the Art

Because conventional web-fed printing presses such as those used for printing newspapers, have traditionally not been expected to produce high quality or high resolution print, a relatively high degree of tolerance for print quality degradation has existed in the printing industry. However, increasing desire for enhanced quality and resolution of printed products has generated a need for printing presses capable of providing printed products having a high level of quality and resolution. The production of higher quality printed products typically involves an attendant reduction in printing speed. Despite this, there is an increased desire within the printing industry for printing presses capable of operating at high speeds. Simultaneously satisfying the needs for quality, resolution, and speed has proven to be a very difficult task.

A conventional printing press typically includes a number of printing units. The relative positions of drive shafts of the printing units must be accurately controlled to maintain proper registration of the different printing units. Proper registration of the different printing units prevents errors such as printing registration errors, web tension errors, web-to-web registration errors, and/or signature cutoff errors. Such errors are aggravated as printing speeds increase.

In certain printing presses, each group of printing units has a drive unit including a drive shaft which is connected with, and driven by, an output shaft of an electric motor for that particular group. A speed controller provides a speed control signal to control the rotational speed of the output shaft of the electric motor. Other groups of printing units as well as non-printing stages within the press can also have drive units. Typically, one of the drive units of the press is designated as a "master", and receives a signal indicating a desired speed for a web of paper passing through the printing press. This desired speed signal is provided to the speed controller of the master to control the speed of the master's drive shaft. Signals representing the actual speed and position of the master's drive shaft are transmitted to the other drive units, designated as "slave" units. The speed controller of each slave unit provides a speed control signal to the slave unit's electric motor based on the actual positions of the slave unit's drive shaft and the master's drive shaft, to cause the slave unit's drive shaft to track both the speed and position of the master unit drive shaft. Ideally, the drive shaft of each slave unit has the same position and speed as the master's drive shaft.

Many types of regulators are available for regulating the position of a slave drive shaft relative to the position of a master drive shaft, such as phase-locked loop regulators and synchro regulators. A synchro regulator typically includes a synchro to transform the angular position of the slave drive shaft into an electrical output signal. The position of the slave drive shaft relative to the position of the master drive shaft is then regulated in response to the electrical output signal from the synchro regulator. regulators having open-loop compensation, such as "forcing", "speed reference", and "dp/dt feed-forward ", are also known. In addition, a "type-3" regulator that doubleintegrates a position error signal (i.e., a difference between the slave and master drive shaft positions) can also be used. Such a regulator is described in U.S. Pat. No. 5,049,798, issued Sep. 17, 1991, which is incorporated by reference into this document.

FIG. 1 illustrates a conventional printing press 10 including infeeds 12 and 14, a group 207 of print units 200–206 and a group 23 of print units 16–22, a dryer 24, chill units 25 and 26, and folder units 28 and 30. Each of the print unit groups 207 and 23 and the folder units 28 and 30 has a drive unit. A master reference signal source 32 provides a signal indicating a desired printing press speed to the drive unit of the group 207, i.e., a speed command signal. The drive unit of the group 207 is designated as a master drive unit. The other drive units corresponding to the group 23 and the folder units 28 and 30 are designated as slave print units, and track the position and speed of the master drive unit.

FIG. 2 shows details regarding internal components of the drive units within the groups 207 and 23 and the folder units 28 and 30, and connections among the drive units and the master reference signal source 32. In particular, the speed command signal from the master reference signal source 32 is input to a speed control 210 of the master drive unit in the group 207 to control a speed of the motor 260. The speed command signal can be an analog signal or a digital signal. A position encoder 230 determines an actual position of a drive shaft 240 driven by the master drive unit motor 260. Since position information provided by the position encoder 230 can be used to derive speed information, the position encoder 230 can optionally provide feedback to the speed control 210 to ensure that the actual speed of the master drive unit drive shaft 240 matches the desired speed.

The speeds and positions of the slave drive unit drive shafts 242–246 are controlled to match the speed and position of the master drive unit drive shaft 240 using the speed of the master drive unit drive shaft 240 together with feedback regarding positions of the slave drive unit drive shafts 242–246 relative to the position of the master drive unit drive shaft 240.

As shown in FIG. 2, the slave drive units have motors 262–266 that drive drive shafts 242–246. Position encoders 232–236 determine actual positions of the drive shafts 242–246 and provide corresponding feedback signals to regulators 222–226 that indicate the determined positions. As noted above with respect to the position encoder 230 of the master drive unit, information provided by the position encoders 232–236 can be used to determine both speeds and positions of the corresponding drive shafts 242–246. The output signal from the position encoder 230, which indicates the actual position of the master drive unit drive shaft 240, is provided as a position reference signal to the regulators 222–226 of the slave drive units within the print unit group 23 and the folder units 28 and 30 as shown in FIG. 2. The regulators 222–226 compare the master drive unit position encoder 230 output signal with the outputs of the position encoders 232–236, and based on the comparison provide command signals to the speed controls 212–216 to control the speed of the motors 262–266 so that the slave drive unit drive shafts 242–246 track the speed and position of the master drive unit drive shaft 240.

According to one configuration of the position encoder 230, the position encoder 230 provides a pulse for each angular increment through which the master drive unit drive shaft 240 rotates. Thus, as the drive shaft 240 rotates, the position encoder 230 will output a stream of pulses. A number of pulses output by the position encoder 230 during a time interval indicates how much the drive shaft 240 changes position during the time interval. An average speed during the time interval can be easily determined by dividing the change in position by the duration of the time interval.

The angular increment corresponding to a pulse is specified so that the position encoder 230 will output 2,048 pulses during each complete revolution. The position encoder 230 is monitored and the pulses output by the position encoder 230 are counted by a counter (not shown). The counter typically turns over upon completion of one revolution, i.e., resets to zero after counting up to 2,048. Some implementations use a different number of pulses per revolution, and other implementations reset the counter less frequently than every revolution. The position encoders 232–236 have a configuration similar to the configuration of the position encoder 230. Positions of the encoders 230–236 can be synchronized by simultaneously resetting the corresponding counters to zero, for example when the paper web is moving through the printing press at a slow and steady velocity. Thereafter, any difference in values of the counters indicates a phase or position difference. For example, if at a certain point in time the value of the counter corresponding to the master drive unit position encoder 230 is 1,000 and the value of the counter corresponding to the slave drive unit position encoder 232 is 795, then at that point in time the position of the slave drive unit drive shaft 242 is lagging the position of the master drive unit drive shaft 240 by 205 angular increments, or about 36°. Computer software accurately tracks phase differences as the counters turn over, and can also track phase differences greater than one complete revolution. In the printing press shown in FIG. 2, each of the regulators 222–226 has a counter (not shown) for counting pulses from the master drive unit position encoder 230, and a counter (not shown) for counting pulses from one of the slave drive unit position encoders 232–236. In some configurations the counters are located within or near the corresponding position encoders.

Although the regulators 222–226 are configured to synchronize slave drive unit drive shaft speeds and positions with those of the master drive unit drive shaft 240, they do not address problems that arise when mechanical disturbances or control errors occur at the master drive unit drive shaft 240. These errors are transmitted to the slave units, which try to emulate the errors. Thus, an error at the master drive shaft can "ripple" down to the slave units. If the disturbances are large, regulator performance is disrupted or compromised, and process problems such as misregistration can result.

Events that can cause speed and position disturbances during printing operations include, for example, a "blanket wash". When a blanket wash is performed, accumulated dirt and lint are washed or brushed from a blanket roller in the printing press. When a blanket wash is performed at the master drive unit, disturbances can occur in the speed and position of the master drive unit drive shaft 240. These disturbances are transmitted to the slave units, potentially disrupting smooth operation of the printing press and resulting in paper waste and reduced print quality. Other printing press operations can also cause disturbances. For example, disturbances can occur when a new paper web is spliced onto an existing web, or when the web is cut at the folder stage.

Because errors at a master unit are transmitted to the slave units, a unit of the printing press where errors occur least frequently and with lowest magnitudes is usually chosen to be a master unit. For example, in a printing press that has infeed units, printing units, drying units, chill roll units and folder units, as shown for example in FIG. 1, one of the printing units is typically chosen to be a master unit instead of one of the folder units. This is because the cutting operation at the folder unit produces a much larger transient disturbance than the blanket wash operation at the printing unit.

Although human operators try to run printing presses as smoothly as possible to minimize transient disturbances that arise at the master drive unit, disturbances do occur. When disturbances occur, filtering networks and reference dead bands are used until the disturbances are identified and corrected. Paper waste and reduced print quality resulting from the disturbances are accepted as a matter of course. However, it would be desirable to provide a printing press wherein effects of transient disturbances are reduced or eliminated so that improved print quality and reduced waste can be achieved, even at higher press speeds.

SUMMARY OF THE INVENTION

The present invention is directed to a method and apparatus for providing disturbance-free speed and position reference signals to drive units in a printing press such as printing units. In accordance with exemplary embodiments, an isolated position reference unit is provided which receives a signal indicating a desired speed of a web moving through a printing press. The isolated position reference unit generates errorfree reference speed and error-free reference position signals that are used to control each of the printing press drive units, such as the print units, without compounding errors resulting from transients associated with mechanical disturbances to the press operation. The same reference signals can be provided to all of the drive units. Alternately, separate reference signals can be generated for each drive unit, and error correction circuits can correct discrepancies between different reference signals generated for different drive units.

Generally speaking, exemplary embodiments relate to a method and system for providing error-free control signals to drive units in a printing press, and include: an isolated position reference unit for generating at least one reference signal based on a desired printing press speed; a plurality of drive units, each having a drive shaft; speed controllers for controlling speeds of the drive shafts; position encoders for providing signals indicating positions of the drive shafts; and regulators for providing command signals to the speed controllers based on the at least one reference signal and the position encoder signals. In accordance with exemplary embodiments, printing press operation can be controlled by determining shaft positions of a plurality of drive unit drive shafts; generating an isolated position reference signal for each of the drive unit drive shafts based on a desired printing press speed; controlling a speed of each drive shaft based on the determined drive shaft position and the isolated position reference signal; and correcting the isolated position reference signal based on a determined drive shaft position of a designated one of the plurality of drive unit drive shafts.

BRIEF DESCRIPTION OF THE DRAWINGS

Other objects and advantages of the present invention will become apparent to those skilled in the art from the following detailed description of preferred embodiments, when read in conjunction with the accompanying drawings, wherein like elements have been designated by like references numerals, and wherein.

DETAILED DESCRIPTION OF THE PREFERRED EMBODIMENTS

Figure 1:
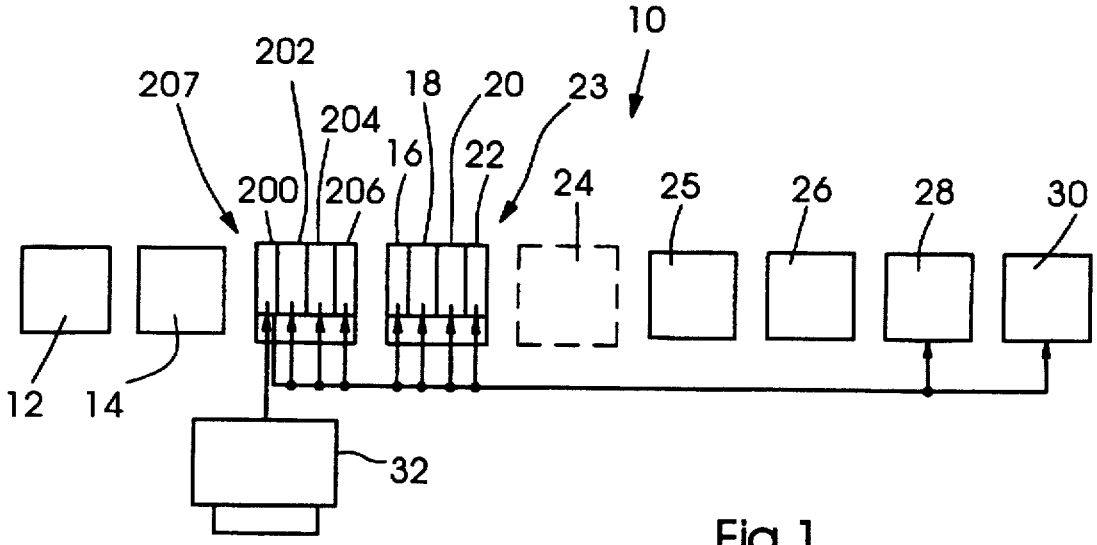
FIG. 1 is a block diagram of a prior art printing press described previously.
Figure 2:
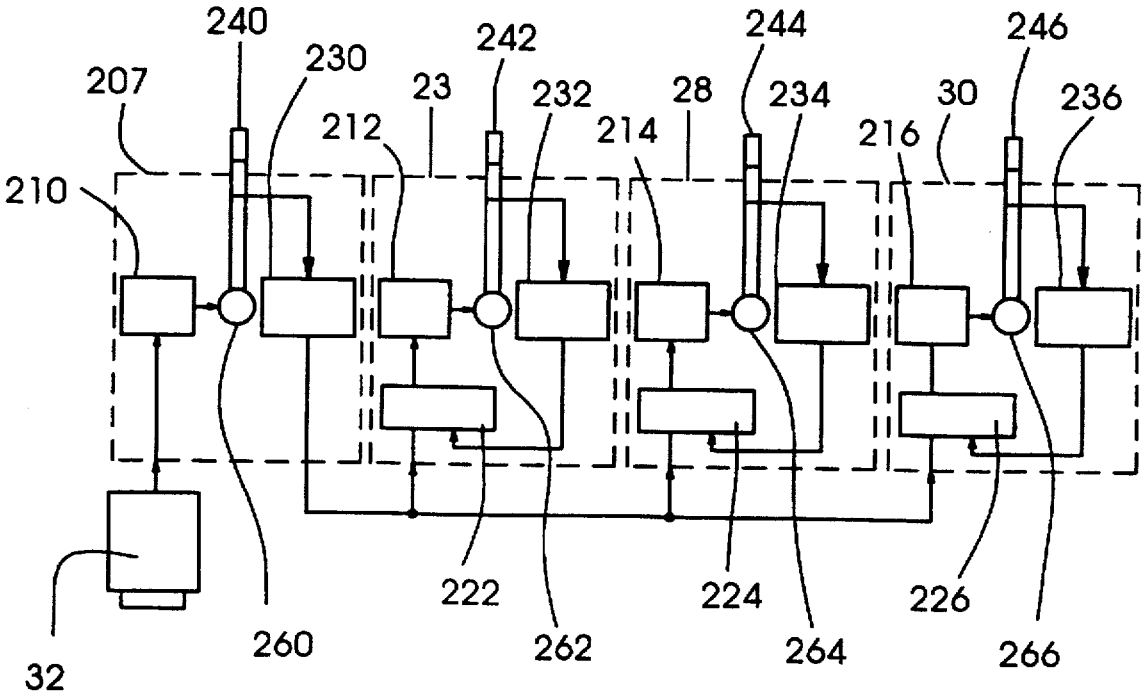
FIG. 2 is a block diagram showing internal construction of some printing press elements shown in FIG. 1.
Figure 3:
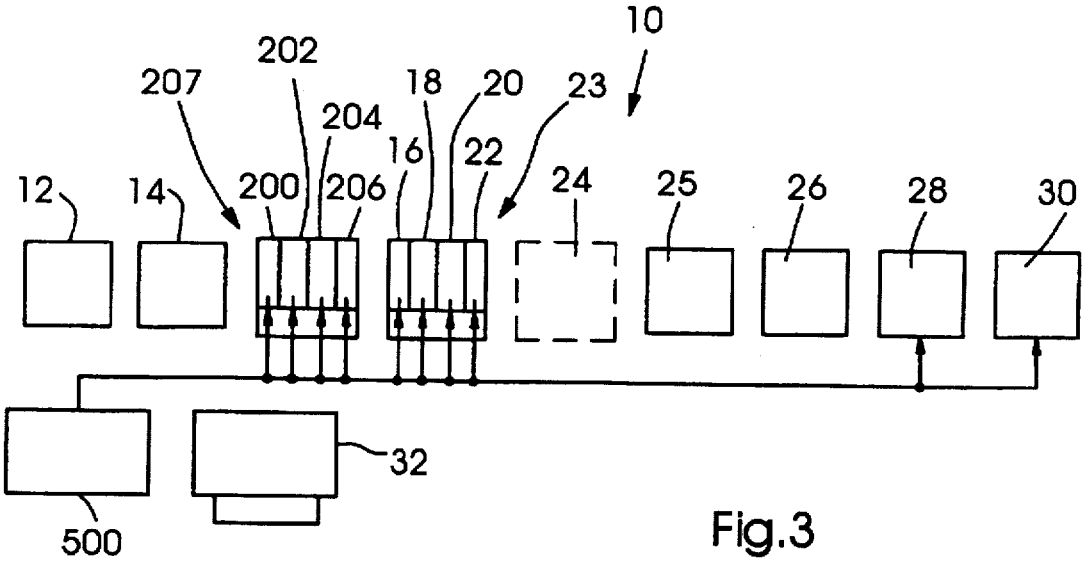
FIG. 3 is a block diagram of a printing press according to a first exemplary embodiment of the invention.

FIG. 3 shows an exemplary printing press, wherein elements similar to those of the FIG. 1 printing press have been designated by like numerals. According to exemplary embodiments of the present invention, none of the print units in a printing press is designated as a master print unit. As shown in FIG. 3, an isolated position reference unit 500 is provided that receives a signal representing a desired printing press speed from a master reference signal source 32, and outputs an isolated position reference signal to each of the print units. Unlike the press shown in FIGS. 1 and 2, each of the print units 200–206 and 16–22, and each of the folder units 28–30 has a separate drive unit.

Figure 4:
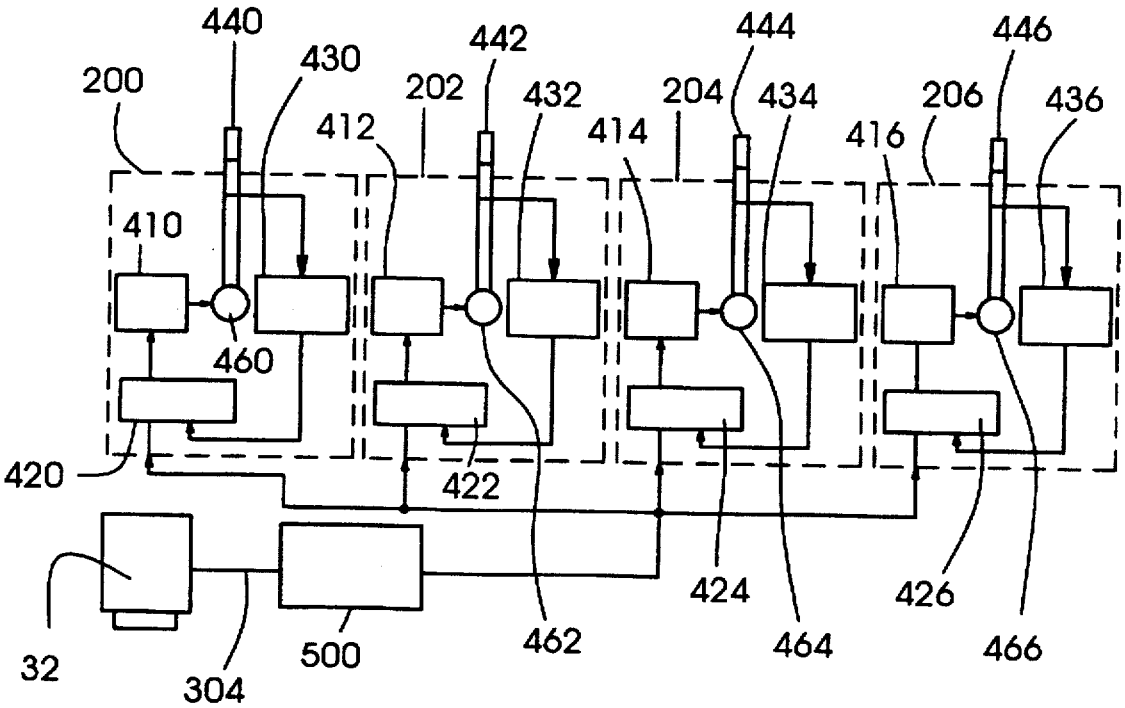
FIG. 4 is a block diagram showing an internal construction of some printing units shown in FIG. 3.

Although the exemplary embodiment shown in FIGS. 3 and 4 has a drive unit for each print unit, those skilled in the art will appreciate that the invention can be easily implemented in a press having only one drive unit for all print units, or for each group of print units. A single drive unit for a group of print units can be controlled in the same way that a drive unit for a single print unit is controlled in the exemplary embodiments described herein.

FIG. 4 shows details of the printing press of FIG. 3, including internal components of the print units 200–206, and connections among the print units 200–206, the isolated position reference unit 500 and the master reference signal source 32. Unlike the components shown in FIG. 2, the drive unit for the print unit 200 is provided with a regulator 420 so that its internal configuration is the same as that of the other drive units shown within the print units 202–206. Each of the regulators 420–426 included within the print units 200–206 receives the isolated position reference signal from the isolated position reference unit 500. The isolated position reference signal can be an analog signal or a digital signal.

The speeds and positions of the drive unit drive shafts 440–446 are controlled to match the reference speed and position indicated by the isolated position reference signal, using the reference speed together with feedback regarding positions of the drive unit drive shafts 440–446 relative to the reference position.

As shown in FIG. 4, the drive units have motors 460–466 that drive drive shafts 440–446. Position encoders 430–436 determine actual positions of the drive shafts 440–446 and provide corresponding feedback signals to regulators 420–426 that indicate the determined positions. As noted above with respect to the position encoder 230 of the master drive unit shown in FIG. 2, information provided by the position encoders 430–436 can be used to determine both speeds and positions of the corresponding drive shafts 440–446. The regulators 440–426 compare the isolated position reference signal with the outputs of the position encoders 430–436, and based on the comparison provide command signals to the speed controls 410–416 to control the speed of the motors 460–466 so that the drive unit drive shafts 440–446 track the speed and position indicated by the isolated position reference signal. Thus, the drive shafts 440–446 do not track or emulate transient mechanical disturbances in the printing operation. Print units 16–22 and folder units 28 and 30 have a similar configuration, and provide the same advantages.

Figure 5:
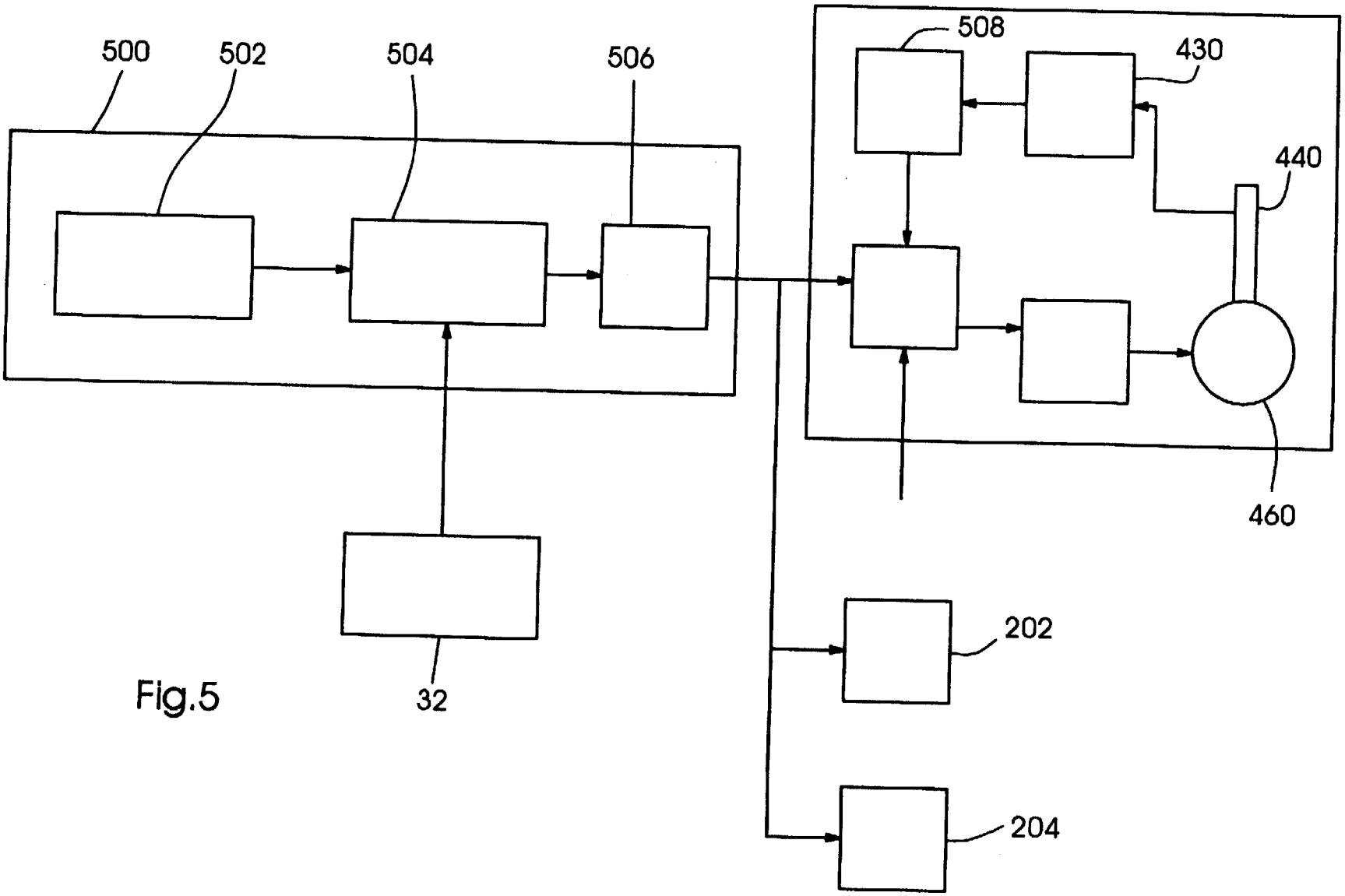
FIG. 5 is a block diagram of a printing press according to a second exemplary embodiment of the invention.

FIG. 5 shows a second exemplary embodiment of the invention, including an exemplary internal configuration of the isolated position reference unit 500. The internal configuration includes an oscillator 502, a divider/multiplier 504, and a filter/amplifier 506. The oscillator 502 generates a clock signal, which is divided or multiplied according to the signal received from the master reference signal source 32, representing the desired printing press speed. The filter/amplifier 506 filters noise from the signal output by the divider/multiplier 504, and inputs the resulting isolated position reference signal to the regulators of the print units. The filter/amplifier 506 also amplifies the signal in any manner desired by the user to render the signal compatible with the print unit regulators. The isolated position reference 500 can be implemented using only electronic components, and can be a solid state device or an analog device.

Each pulse of the isolated position reference signal output by the isolated position reference 500 represents an angular increment through which a drive shaft must move. The angular increment has a predetermined value. Thus, a number of pulses that occur in the isolated position reference signal within a time interval indicates a change in reference position during that time interval, and the frequency of the pulses indicates a reference rotational speed or angular velocity.

FIG. 5 shows a counter/sampler 508 in the print unit 200, connected between the regulator 420 and the position encoder 430, that can be used to supplement the processing capability of the regulator 420, and/or provide information from the position encoder 430 in a more useful form. For example, the counter/sampler 508 can provide a signal indicating a number of position increments through which the drive shaft 440 has moved during a time interval, i.e., a change in position during the time interval.

The regulator 420 contains a counter (not shown) to count pulses received from the isolated position reference 500, which can be compared with the pulses counted by the counter/sampler 508 to determine any phase difference between the reference position and the position of the drive shaft 440. Alternately, the counter can be located within the divider/multiplier 504 in the isolated position reference unit 500, so that the signal output by the isolated position reference unit is a pulse count. The regulator 420 can also receive a delay compensation signal to compensate for undesirable signal delays or discrepancies that can occur in the system. For example, where print units are located at different distances from the isolated position reference unit and/or are connected with the isolated position reference unit using different signal transmission paths, the same signal from the isolated position reference unit will arrive at different times at the print units due to differences in characteristics of the signal transmission paths, such as length. These configurations can, of course, be similarly applied to the print units 202–206 and 16–22 and folder units 28–30.

Figure 6:
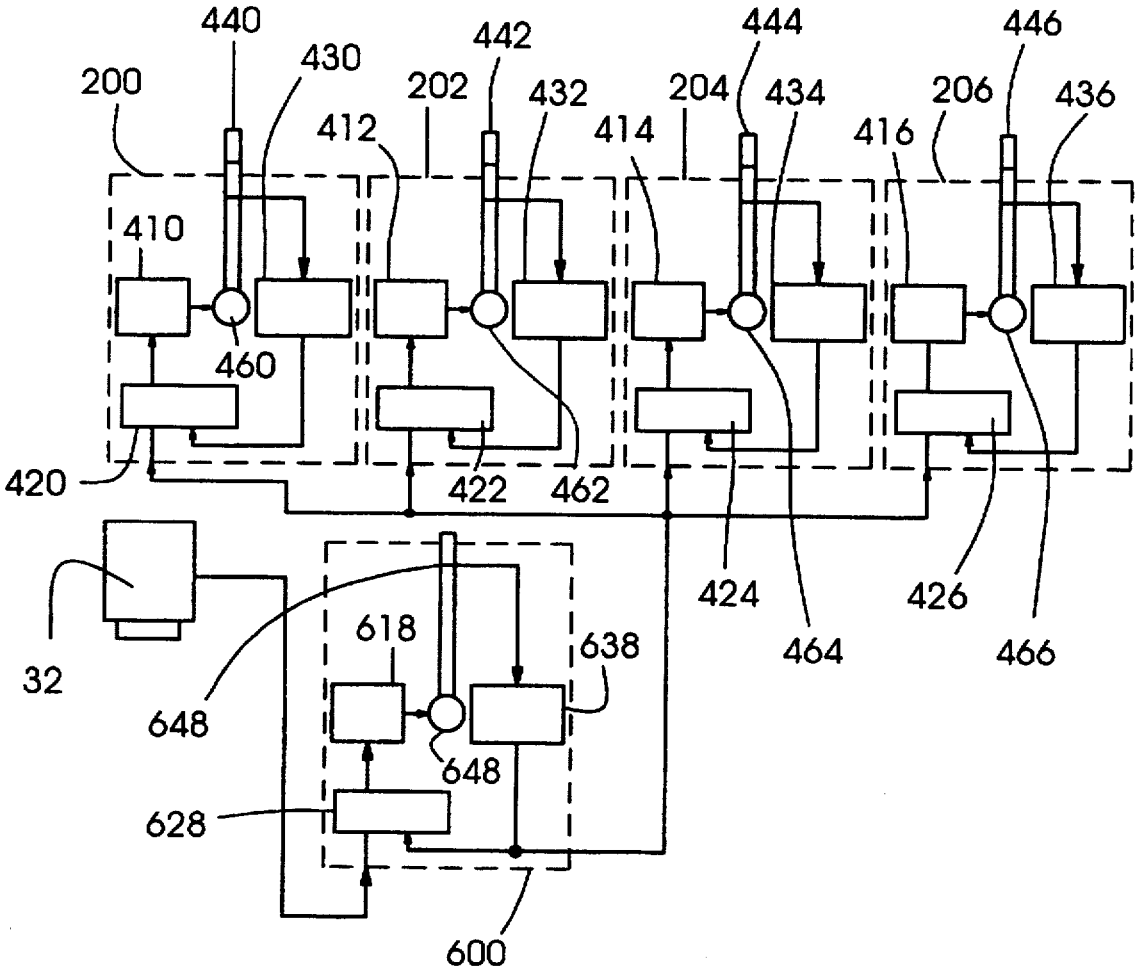
FIG. 6 is a block diagram of a printing press according to a third exemplary embodiment of the invention.

FIG. 6 shows a third exemplary embodiment of the invention, including a configuration of the isolated position reference unit 500. This configuration includes a motor 668, a drive shaft 648, a position encoder 638, a speed control 618, and a regulator 628. The internal configuration of the isolated position reference unit 500 is similar to that of the print units 200–206 shown in FIG. 4, but differs in several ways. First, the drive shaft 648 is not connected to any of the printing press operations and thus is not subject to undesirable mechanical disturbances resulting from printing press operations, such as blanket washes. The drive shaft 648 can be connected, for example, to a load (not shown) that has smooth, predictable behavior characteristics and is free of transient disturbances that could cause problems in operation of the printing press. Second, the regulator 628 receives the speed command signal from the master reference signal source indicating the desired printing press speed. Third, the signal output by the position encoder 638 is the isolated position reference signal, and is input to the regulators 420–426 of the print units 200–206. The motor 668 can be selected independently of other motors used in the printing press. For example, the motor 668 can be smaller than the motors 460–466, and can be a servo motor.

The regulator 628 of the isolated position reference unit 600 regulates the speed control 618 using speed feedback to maintain a speed of the drive shaft 648 as close as possible to the indicated desired speed. In contrast, the regulators 420–426 regulate the respective speed controls of the print units 200–206 so that the drive shafts 440–446 accurately track the speed and position of the drive shaft 648.

Figure 7:
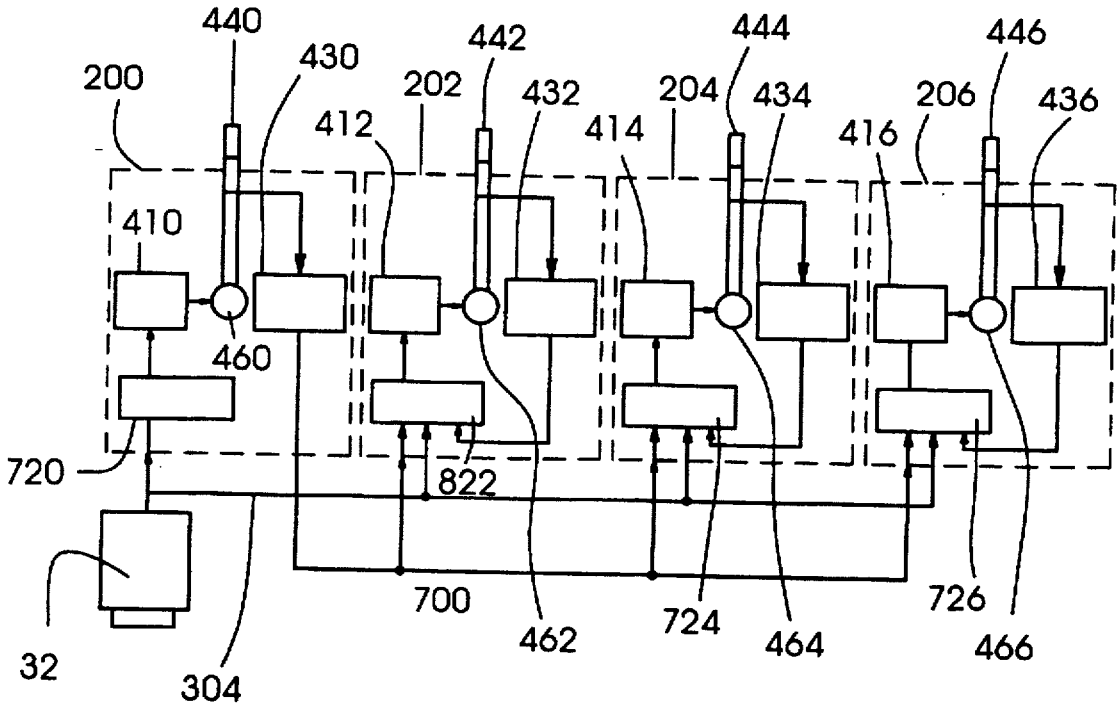
FIG. 7 is a block diagram of a printing press according to a fourth exemplary embodiment of the invention.

FIG. 7 shows a fourth exemplary embodiment of the invention. In this embodiment the master reference signal source 32 provides a speed command signal representing a desired printing press speed directly to regulators 720, 822, 724 and 726, which correspond respectively to print units 200–206. The isolated position reference unit is actually made up of components within, and connections between, the regulators. That is, each of the regulators internally generates an isolated position reference signal based on the speed command signal from the master reference signal source 32. Within each regulator, the isolated position reference signal is compared with drive shaft speed and position information provided by the position encoder for the corresponding drive unit. Based on the comparison, the regulator generates a command signal for input to a corresponding speed control so that the drive shaft tracks the reference speed and position indicated by the isolated position reference signal.

To compensate for discrepancies that can arise over time between isolated position reference signals generated by different regulators, and to avoid problems in the printing process that would result from such discrepancies, the isolated position reference signals generated within the various regulators can be periodically corrected or standardized. In this embodiment, the print unit 200 is chosen to be a standard, and the signal 700 output by its position encoder 430 is used by all the other print units as the standard to which the isolated position reference signal of each of the print units is periodically conformed. In accordance with exemplary embodiments, the isolated position reference signals are corrected or standardized at a time when the print unit chosen as the standard is not being influenced by transient disturbances.

This configuration can, for example, be used in situations where the invention is applied to an existing printing press that, due to original design limitations, cannot transmit the same isolated position reference signal to all of its drive units.

Figure 8:
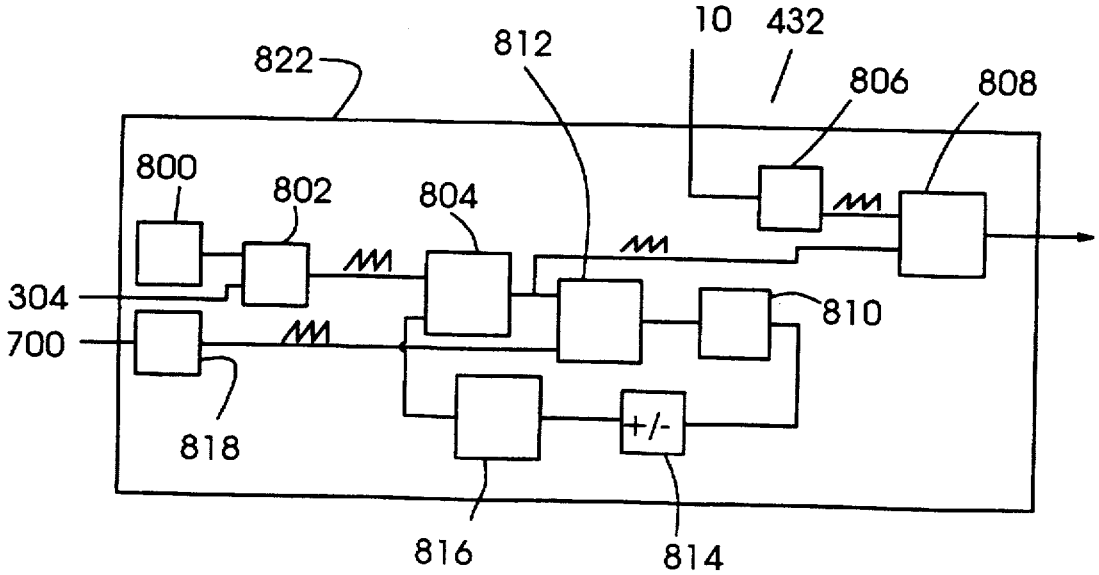
FIG. 8 is a block diagram showing an internal construction of regulators shown in FIG. 7.

FIG. 8 shows an internal configuration of the regulator 822 of FIG. 7. As shown in FIG. 8, an oscillator 800 generates a clock signal in a manner similar to the isolated position reference 500 shown in FIG. 5. The clock signal is input to a divider/multiplier 802 which divides or multiplies the clock signal based on the speed command signal received from the master reference signal source 32 via the line 304, and also counts pulses of the divided or multiplied clock signal. A signal adjuster 804 filters noise from the pulse count signal outputted by the divider/multiplier 802, and amplifies the signal appropriately. The signal adjuster 804 can also adjust the signal to synchronize it with the standard signal 700. The signal output from the signal adjuster 804 is an isolated position reference signal for the print unit 202, and is input to a position register 808. The position register 808 also receives a signal from a counter 806 indicating a detected number of pulses received by the counter 806 from the position encoder 432. For example, as with the counter/sampler 508 shown in FIG. 5, the counter 806 can provide a signal indicating a number of position increments through which the drive shaft 442 has moved during a time interval, i.e., a change in position during the time interval.

The position register 808 compares the signals input from the counter 806 and the signal adjuster 804. The signals respectively represent a change in drive shaft 442 position and a change in the reference position during a time interval, and also indicate reference and drive shaft 442 speeds. Based on the comparison, the position register 808 generates a command signal for input to the speed control 412, in accordance with general principles of regulator function well known to those of ordinary skill in the art and implemented, for example, in the regulator 222 of the FIG. 2 prior art printing press.

An exemplary circuit for correcting or standardizing the isolated position reference signal generated in the regulator 822 includes a counter 818, a comparator 812, an error detector 810, an error compensator 814, and a correction rate limiter 816. The counter 818 operates similarly to the counter/sampler 508 shown in FIG. 5 and the counter 806. The print unit 200 is chosen to be the standard print unit. Accordingly, the counter 818 detects a number of pulses received from the position encoder 430 of the standard print unit 200. The counter 818 provides a signal indicating a number of position increments through which the drive shaft 440 has moved during a time interval, i.e., a change in position during the time interval.

The output signal of the counter 818 and the isolated position reference signal from the signal adjuster 804 are both input to the comparator 812. The comparator 812 compares the two signals, and produces an error signal based on the comparison. The comparator output signal is input to the error detector 810, which detects the presence and magnitude of error between (a) the output signal of the counter 818, i.e., the position and speed of the drive shaft 440 of the standard print unit 200 as detected by the position encoder 430, and (b) the reference speed and position as represented by the isolated position reference signal output from the signal adjuster 804. The error detector 810 outputs a signal indicating the determined error, and the signal is input to an error compensator 814 that generates a control signal to cause the signal adjuster 804 to correct or conform the isolated position reference signal to the position and speed of the drive shaft 440 of the standard print unit 200. A correction rate limiter 816 can be connected between the error compensator 814 and the signal adjuster 804, to slow the correction process by constraining the output signal of the error compensator 814.

Alternately, the components in each regulator that are used to generate the isolated position reference signal for the drive unit corresponding to the regulator can be located outside the regulator. For example, the regulator 822 could contain the counter 806 and the position register 808, and receive an output signal from the position encoder 432 and an output signal from the signal adjuster 804. The components including the oscillator 800, the divider/multiplier 802, the signal adjuster 804, the comparator 812, the error detector 810, the error compensator 814, the correction rate limiter 816, and the counter 818 can be located anywhere so long as they remain properly connected and output from the signal adjuster 804 is provided to the regulator 822, the master reference signal 304 is provided to the divider/multiplier 802, and the standard position encoder signal 700 is provided to the counter 818.

The other print units 204, 206 can have the same configuration and operation as the print unit 822. Where the FIG. 8 configuration is applied, for example, to the prior art printing press shown in FIG. 2, those skilled in the art will recognize that the print unit group 23 and the folder units 28 and 30 of the FIG. 2 printing press can have the same configuration as print unit 822.

It will be appreciated by those skilled in the art that the present invention can be embodied in other specific forms without departing from the spirit or essential characteristics thereof. For example, the isolated position reference signal can be generated in a variety of ways, and can take any form that allows determination of a reference speed and a difference in position between the reference position represented by the isolated position reference signal and the position of a drive shaft, so that the drive shaft can be controlled to track the reference speed and position. The presently disclosed embodiments are therefore considered in all respects to be illustrative and not restricted. The scope of the invention is indicated by the appended claims rather than the foregoing description and all changes that come within the meaning and range and equivalents thereof are intended to be embraced therein.

What is claimed is:

1. Apparatus for controlling a printing operation of a printing press comprising:

an isolated position reference unit for generating at least one isolated position reference signal that is isolated from printing operation disturbances and based on a desired printing press speed;

at least one drive unit having a drive shaft for driving the printing press;

a position encoder for providing a signal indicating a position of the drive shaft;

a speed controller for controlling a speed of the drive shaft; and a regulator for providing a control signal to the speed controller based on the isolated position reference signal and the position encoder signal.

2. The apparatus of claim 1, wherein the isolated position reference signal comprises at least one of a reference speed signal and a reference position signal.

3. The apparatus of claim 2, wherein the printing operation disturbances include disturbances resulting from at least one of cutting a print medium on which the printing press prints images, performing a blanket wash operation, and splicing a web of print medium onto an existing web of print medium.

4. The apparatus of claim 1, wherein the isolated position reference unit comprises:

an oscillator for generating a reference signal;

a frequency divider for dividing the reference signal based on the desired printing press speed.

5. The apparatus of claim 1, wherein the drive unit further comprises a counter operatively connected between the position encoder and the regulator for detecting a change in position of the drive shaft during a sample time.

6. The apparatus of claim 1, wherein the control signal provided by the regulator is also based on a delay compensation signal for a signal path connection between the isolated position reference unit and the regulator.

7. The apparatus of claim 1, wherein the isolated position reference unit comprises:

a motor with an output shaft isolated from the printing press;

a speed controller for controlling a speed of the output shaft;

a position encoder for providing a signal indicating a position of the output shaft, wherein the position encoder signal is the isolated position reference signal; and a regulator for providing a control signal to the speed controller based on the isolated position reference signal and the desired printing press speed.

8. The apparatus of claim 7, further comprising a master reference signal source for providing a signal to the isolated position reference unit representing the desired printing press speed.

9. The apparatus of claim 8, wherein the signal provided by the master reference signal source is a digital signal.

10. The apparatus of claim 1, wherein the isolated position reference unit is a solid state electronic device.

11. The apparatus of claim 1, wherein the isolated position reference unit generates a plurality of isolated position reference signals based on the desired printing press speed; and the apparatus further comprises:

a plurality of drive units each having a drive shaft, a speed controller for controlling a speed of the drive shaft, a position encoder for providing a signal indicating a position of the drive shaft, and a regulator for providing a control signal to the speed controller based on the position encoder signal and at least one of the plurality of isolated position reference signals.

12. The apparatus of claim 11, wherein the isolated position reference unit further comprises at least one error correction circuit for correcting at least one of the plurality of isolated position reference signals based on an output from a position encoder of a designated one of the plurality of drive units.

13. The apparatus of claim 12, wherein one of the plurality of drive units is designated as a master drive unit, and others of the plurality of drive units are designated slave drive units; and the isolated position reference unit comprises:

for each of the slave drive units, an oscillator for generating a signal;

a frequency divider for generating a signal by dividing the oscillator signal based on the desired printing press speed;

a pulse adder/subtractor for generating the isolated position reference signal by changing the number of pulses in the signal generated by the frequency divider;

a comparator for comparing the isolated position reference signal generated by the pulse adder/subtractor with the master drive unit position encoder signal and generating a signal based on the comparison;

an error detector for detecting an error between the isolated position reference signal generated by the pulse adder/subtractor and the master drive unit position encoder signal; and an error correction unit for generating a control signal to control the pulse adder/subtractor based on the detected error.

14. The apparatus of claim 13, wherein the isolated position reference unit further comprises a correction rate limiter for constraining the control signal generated by the error correction unit.

15. The apparatus of claim 11, wherein the regulators contain components of the isolated position reference unit.

16. A method for controlling a printing operation of a printing press comprising the steps of:

generating an isolated position reference signal that is isolated from printing operation disturbances based on a desired printing press speed;

determining a position of a drive shaft of at least one drive unit of the printing press; and controlling a rotational speed of the drive shaft based on the isolated position reference signal and the determined drive shaft position.

17. The method of claim 16, wherein the step of generating the isolated position reference signal comprises:

generating a clock signal having a predetermined frequency;

dividing the clock signal based on the desired printing press speed;

filtering noise from the clock signal; and amplifying the clock signal.

18. The method of claim 16, further comprising the step of determining a change in position of the drive shaft during a sample time.

19. The method of claim 16, wherein the step of controlling the rotational speed of the drive shaft is also based on a delay compensation signal.

20. The method of claim 16, wherein the step of generating an isolated position reference signal comprises:

determining a drive shaft position of a having a drive shaft isolated from the printing press;

generating the isolated position reference signal based on the determined drive shaft position; and controlling a rotational speed of the drive shaft based on the isolated position reference signal and the desired printing press speed.

21. A method for controlling a printing operation of a printing press comprising the steps of:

determining a drive shaft position of each of a plurality of drive units;

generating at least one isolated position reference signal for each of the plurality of drive units based on a desired printing press speed; and controlling a speed of each of the drive shafts based on the determined drive shaft position and the at least one isolated position reference signal.

22. The method of claim 21, further comprising the step of correcting the at least one isolated position reference signal based on a determined drive shaft position of a designated one of the plurality of drive units.

23. The method of claim 22, wherein the steps of generating and correcting the at least one isolated position reference signal comprise:

at each of the undesignated drive units, generating a clock signal;

dividing the clock signal based on the desired printing press speed;

determining a drive shaft position and speed of the designated one of the drive units;

comparing the determined drive position and speed with the divided clock signal; and altering the divided clock signal based on the comparison.

24. Apparatus for controlling a printing operation of a printing press comprising:

isolated position reference means for generating an isolated position reference signal based on a desired printing press speed;

at least one drive unit for driving the printing press, the drive unit comprising a drive shaft;

speed control means for controlling a speed of the drive shaft;

position encoding means for providing a signal indicating a position of the drive shaft; and regulating means for providing a control signal to the speed control means based on the isolated position reference signal and the position encoding means signal to conform the drive shaft position to a reference position indicated by the isolated position reference signal.

25. Apparatus for controlling a printing operation of a printing press comprising:

isolated position reference means for generating a plurality of isolated position reference signals based on a desired printing press speed; and a plurality of drive units each having a drive shaft, speed control means for controlling a speed of the drive shaft, position encoding means for providing a signal indicating a position of the drive shaft, and regulating means for providing a control signal to the speed control means based on the position encoding means signal and at least one of the plurality of isolated position reference signals.

26. The apparatus of claim 25, wherein the isolated position reference means further comprises at least one error correction means for correcting at least one of the plurality of isolated position reference signals based on an output from the position encoding means of a designated one of the plurality of drive units.

* * * * *